US005127065A

United States Patent [19]

Wade

[11] Patent Number: 5,127,065

[45] Date of Patent: Jun. 30, 1992

[54] OPENING DEVICE FOR FLEXIBLE PACKAGING

[76] Inventor: Steven E. Wade, 100 Main St., Winona, W. Va. 25942

[21] Appl. No.: 510,203

[22] Filed: Apr. 17, 1990

[51] Int. Cl.[5] ..... B65D 3/26

[52] U.S. Cl. ..... 383/206; 383/200

[58] Field of Search ..... 206/601, 603, 610, 628, 206/632, 633, 618, 615; 220/279, 284

[56] References Cited

U.S. PATENT DOCUMENTS

| | | | |
|---|---|---|---|
| 2,119,793 | 6/1938 | Plageman | 206/603 |
| 2,152,400 | 3/1939 | Rold | 206/603 |
| 2,263,353 | 11/1941 | Eidam | 206/603 |
| 3,259,235 | 7/1966 | Scowle . | |
| 3,397,835 | 8/1968 | Henning | 206/610 |
| 3,615,711 | 10/1971 | Markus et al. . | |
| 3,695,417 | 10/1972 | Stoker, Jr. . | |
| 3,730,337 | 5/1973 | White . | |
| 3,799,389 | 3/1974 | Bloeck | 220/279 |
| 4,027,819 | 6/1977 | Herrera-Gutierrez | 206/603 |
| 4,363,406 | 12/1982 | Salvadori . | |
| 4,480,752 | 11/1984 | Jacobs . | |
| 4,597,450 | 7/1986 | Budmiger | 206/610 |
| 4,619,650 | 10/1986 | Wisdom . | |
| 4,664,263 | 5/1987 | Emslander et al. | 206/630 |
| 4,696,404 | 9/1987 | Corella | 206/633 |
| 4,708,249 | 11/1987 | Emslander et al. | 206/628 |
| 4,792,060 | 12/1988 | Brogli . | |
| 4,925,034 | 5/1990 | Robichaud et al. | 206/603 |

FOREIGN PATENT DOCUMENTS

| | | | |
|---|---|---|---|
| 1065305 | 5/1954 | France | 206/628 |

*Primary Examiner*—David T. Fidei

[57] ABSTRACT

An opening device for flexible packaging is provided to concentrate tearing forces and provide increased tearing leverage, facilitating the opening of the packaging without the need for a sharp object to initiate the tear, the opening device having first and second wings spaced apart from one another at a narrow distance and joined at a proximal end by an integral web, which acts as a fulcrum for each of the wings as they are rotated to initiate the tear. The opening device is securely fastened to a peripheral edge of the package and a predetermined portion of the first and second wings extend outwardly away from the peripheral edge, the wings serving as gripping surfaces which are rotated apart from one another in initiating the tear in the package.

23 Claims, 4 Drawing Sheets

OPENING DEVICE FOR FLEXIBLE PACKAGING

BACKGROUND OF THE INVENTION

1. Field of the Invention

The present invention relates to a device which is fastened to flexible packaging to assist in tearing open the packaging without the use of an additional tool.

2. Description of Related Art

A major consideration in designing packaging for various consumer products is the manner in which the packaging may be opened by the end user of the product. As an example, steel and aluminum cans have long been used to contain individual servings of carbonated and non-carbonated beverages. Initially, such cans required the use of an additional tool, the can opener, to pierce an opening or openings in the lid portion of the can in order to extract the beverage. A significant disadvantage associated with this type of packaging was that can openers were not always readily available when a person wished to open the can.

Recognizing this disadvantage, package designers developed the "flip-top" can, which now enjoys widespread use in individual serving sized cans. The flip-top employs the physical principles of leverage and isolation of stressed material to eliminate the need for an additional tool, such as the can opener, because a leveraging means and a weakened region of the lid are provided on each can. Consumer reaction to this and other improvements, however slight, in package opening convenience has been so overwhelmingly positive that it is presently difficult to find cans or boxes requiring additional tools to open them.

In the field of flexible packaging, e.g., polymeric bags, however, one often finds that opening the package requires a separate or additional tool such as a pair of scissors, a knife, or one of numerous tools sold for the express purpose of performing the package opening function. While most flexible packaging for consumer goods is ostensibly designed to be opened with normal manual effort, in reality many of these packages require near-superhuman effort to effect the opening of the package, and many consumers thus resort to the use of an opening tool.

Numerous approaches have been taken to alleviate the problem of opening bag-type flexible packaging without the need for an additional tool. Slits or v-notches have been provided on the edges of packages in order to provide a tear initiation site, which overcomes one problem associated with the opening of flexible packaging. Some packaging designs have employed a weakened line of material extending through the package which is somewhat similar in concept to scoring the lid of a flip-top can in that the weakened line provides a "path of least resistance" for tear propagation, and tends to concentrate tearing stresses in that region. It should be readily apparent that employing weakened lines in the packaging material has the disadvantage that the package might be inadvertently opened in the transportation or handling of the packages prior to reaching the end user.

Tear strips or tear strings have also been employed in flexible packaging in order to avoid the necessity of using an opening tool. The use of tear strips or tear strings often complicates the packaging operation itself, thereby driving up the product manufacturing cost, which is ultimately passed on to the consumer. Finger or hand grasping means have previously been employed in attempts to facilitate the opening of flexible packaging. The grasping means previously employed have generally been integral extensions of the packaging material itself, or exposed extensions of tear strips or tear strings. Such grasping means, while improving the ability to apply tearing forces to the package, have not provided any substantial force magnification or stress concentration which would ease the opening of the package.

It is therefore an important object of the present invention to provide an opening device which is fixedly attached to a flexible packaging container, and which provides multiplication of tearing forces and concentration of tearing stress in an isolated region of the packaging to facilitate the opening of the packaging by exertion of manual force.

It is a further important object of the present invention to provide an opening device which is to be fixedly attached to a flexible packaging container and which comprises a pair of closely spaced wing-like members, the distal ends of which extend from a peripheral edge of the packaging, the wing-like members being joined at their proximal ends by a web extending between the wing-like members, wherein the web and a portion of each wing are secured to the packaging.

It is another important object of the present invention to provide a flexible package opening device made of a relatively inexpensive material and which is further easily secured to the flexible package as the package is formed and sealed, the opening device providing means for concentrating and isolating tearing stresses at a predetermined narrow region of the package and a means for increasing a tearing force exerted by a person opening the package.

SUMMARY OF THE INVENTION

The above and other objects of the present invention are accomplished by providing an opening device comprising a substantially rigid pair of wing-like members joined at a proximal end by an integral web, the pair of plastic wings being closely spaced from one another and defining a narrow slit therebetween. The web and a portion of the length of each wing-like member are secured or fixedly attached to a package made of flexible material, and the distal ends of the wings extend outwardly from a peripheral edge of the package. The opening device is fixedly attached to the package during the packaging and sealing process by heat sealing the device to the package material in the desired location or by other suitable attachment means.

The device assists in opening the package by providing increased leverage in applying tearing forces, as well as providing an isolation of a narrow region of flexible material in the space between the two wings, which focuses or concentrates the tearing forces and stresses in that region of the package. A person desiring to open the package may grip each of the substantially rigid wing-like members near the distal ends thereof between a thumb and forefinger, and may simply move or rotate the members relative to one another out of the plane in which the wing-like members are originally disposed. Because the members are substantially rigid and are hinged together by the web at a proximal end of the device, the web acts as a fulcrum point, and additional leverage is provided, as the force applied by the person opening the package is applied at a greater distance than if he or she were grasping the bag directly at the peripheral edge. Further, the tearing forces are focused or concentrated only in the narrow slit region between the wing-like members because the package and the device are secured together along a portion of the length of the wing-like members.

The increased leverage and the concentration of tearing stresses will initiate and begin the propagation of a tear in the peripheral edge of a wide variety of flexible packaging materials. As the distal ends of the wing-like members are moved or rotated farther apart relative to one another, the tear propagates inwardly from the peripheral edge of the package toward the proximal ends of the wing-like members and the web connecting the members. The opening device is designed and is secured to the package in such a manner that the web will fracture just prior to or substantially concurrently with the leading edge of the propagating tear reaching that point, due to the increased stress in that area resulting from the increased separation between the distal ends of the opening device.

As indicated previously, the opening device may be heat sealed or otherwise securely adhered to one of the outer surfaces of the package at a selected peripheral edge of the package. Alternatively, the device may be sealed or securely adhered between two mating inner surfaces of the peripheral portions of the package which are themselves sealed together in sealing the package. The device thus provides an inexpensive and reliable means for opening flexible packaging which eliminates the need for an additional tool in opening the package.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention, taken in conjunction with the accompanying drawings wherein like reference characters represent like parts throughout the several views.

DETAILED DESCRIPTION OF THE PREFERRED EMBODIMENTS

Figure 1:
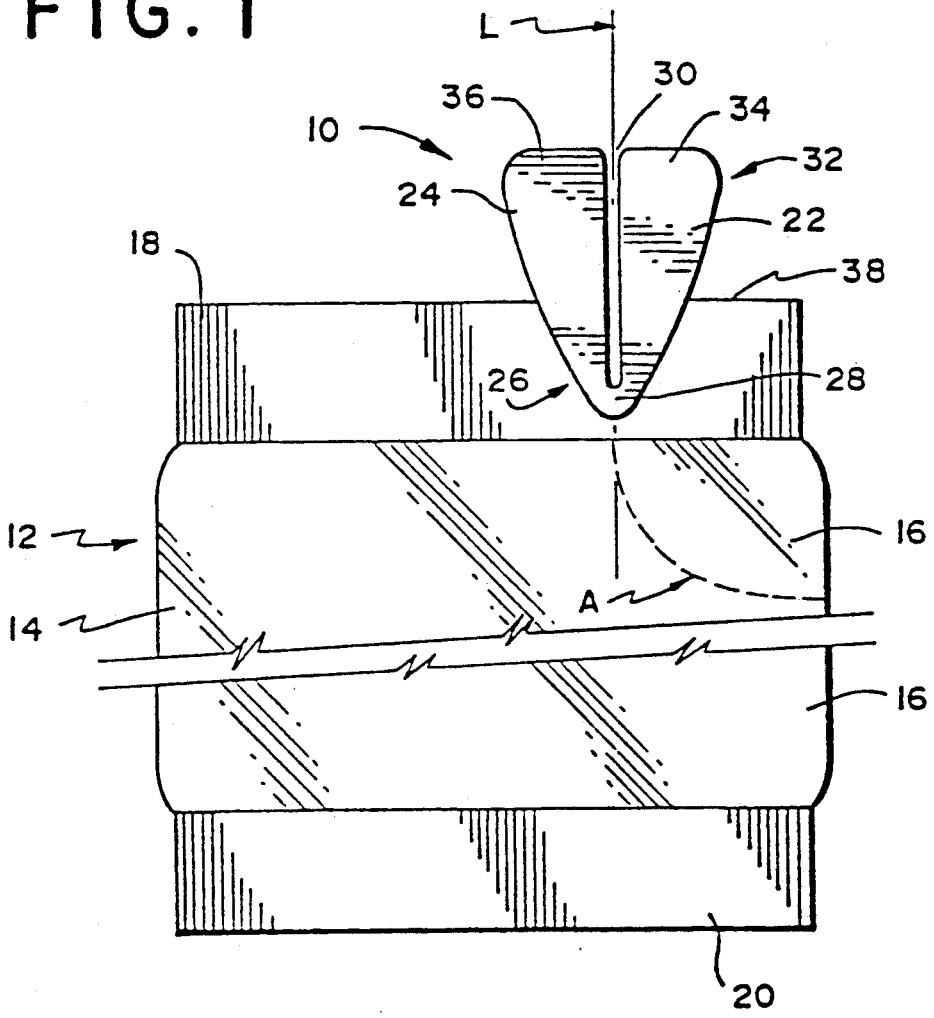
FIG. 1 is an elevation view of the opening device according to a preferred embodiment of the present invention, secured in position to a flexible package.

Referring initially to FIG. 1, an opening device 10 according to a preferred embodiment of the present invention is shown secured to a package 12 made of a flexible packaging material. The opening device 10 is preferably securely fastened or adhered to the package in any one of several ways which will be discussed later in the specification. The device 10 of the present invention is suitable for use with most, if not all, types of packaging materials and package designs which are designed to be torn open to gain access to the contents of the package. Examples of the types of packaging materials with which the device 10 is suitable for use include polyurethane, polyethylene, and other polymeric bag materials, thin foil type sealed packages, heavier weights of paper not easily torn by hand, and foil lined polymeric or paper packaging materials, hereafter referred to as flexible packaging materials. The above list is not, however, to be regarded as all-inclusive, and is provided only to show examples of those types of materials which fall under the collective name "flexible packaging materials".

In the preferred embodiment of FIG. 1, the device 10 is secured to a sealed bag 14, which may be made of polyurethane or the other materials listed above. As is typical of such bags, a sheet of the material forms a contents section 16 of the bag, and the bag is sealed in an airtight manner at an upper sealed end 18 and a lower sealed end 20, forming an enclosure completely around the contents.

The opening device 10 comprises a pair of wing-like members, hereinafter referred to as first wing 22 and second wing 24, joined at a first end, hereinafter termed a proximal end 26 of the device, by a web 28. First and second wings 22, 24, which are preferably sized to accommodate the pads of the index finger and thumb of the user (FIGS. 3, 4), are spaced apart at a narrow predetermined distance by a slit 30 extending from web 28 to a distal end 32 of the opening device 10. The device as shown is substantially symmetrical about a longitudinal axis L extending in the direction of and bisecting the space defined by slit 30.

As can be seen in FIG. 1, preferably only a portion of the opening device 10 is secured to the bag 14, thereby positioning the distal ends 34, 36 of first and second wings 22, 24 to extend outwardly from an upper peripheral edge 38 of the bag. It is preferred that the device 10 be secured to the bag 14 along approximately one-third to one-half of the full length of the device. In the FIG. 1 embodiment, the device is secured to the bag on the upper sealed end 18 thereof, and the slit 30 is oriented such that if the slit were extended inwardly away from the upper peripheral edge of the bag 14, the slit would eventually reach a point at which upper sealed end 18 meets the contents section 16 of the bag. It is possible, if desired, to provide an opening device 10 having sufficient length such that the proximal end 26 of the device actually extends completely across the sealed end 18 of the bag, and onto an exterior surface of the contents section 16 of the bag.

The device serves as a means for initiating and propagating a tear in the package through the sealed end, and into the contents section 16, and in the FIG. 1 orientation is preferably used to tear off a corner portion of the contents section, as indicated by broken line A.

Figure 2:
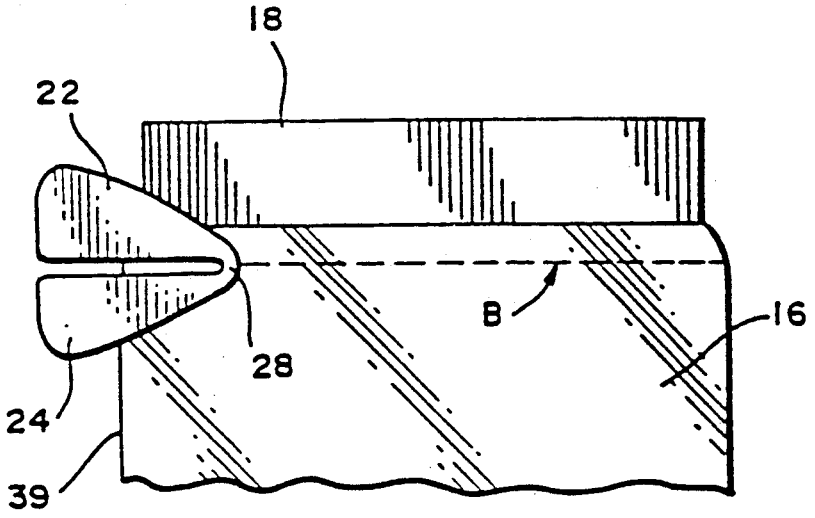
FIG. 2 is an elevation view of the opening device of the present invention secured in an alternate position to a flexible package.

The FIG. 2 embodiment of the opening device 10 of the present invention differs from that of FIG. 1 substantially only in the positioning of the device on bag 14. In this Figure, the device 10 is affixed to the bag in a position adjacent the sealed end 18 of the bag, and at a peripheral edge 39 of the contents section 16 of the bag, wherein the slit 30 extends in a direction extending through the contents section, and preferably parallel to the upper sealed end 18 of the bag. When positioned in such an orientation, the device 10 may be used to initiate and propagate a tear in the package across a top portion thereof, as indicated by broken line B. It is to be recognized from viewing FIG. 2 that the term peripheral edge is used herein not only to refer to a sealed end of a bag 14, such as that shown in FIG. 1, but also to refer to any peripheral boundary of a bag or other type of package.

The operation of the opening device 10 will be discussed by referring particularly to FIGS. 3–5. The present invention was developed in recognition of the fact that the initiation and initial propagation of a tear in the flexible packaging is the largest obstacle in opening a package. As indicated previously, the initiation and initial propagation of a tear in many instances requires the use of a knife, scissors or other sharp object. The opening device 10 of the present invention obviates the need for a separate instrument by providing added leverage and concentration of the tearing forces, such that the package can be opened by hand.

Figure 3:
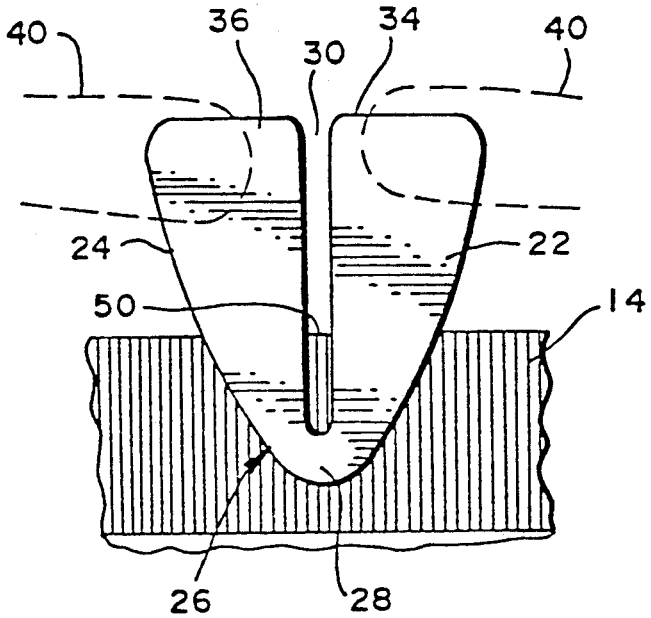
FIG. 3 is an enlarged elevation view of the opening device and the edge of a flexible package to which the opening device is secured.
Figure 4:
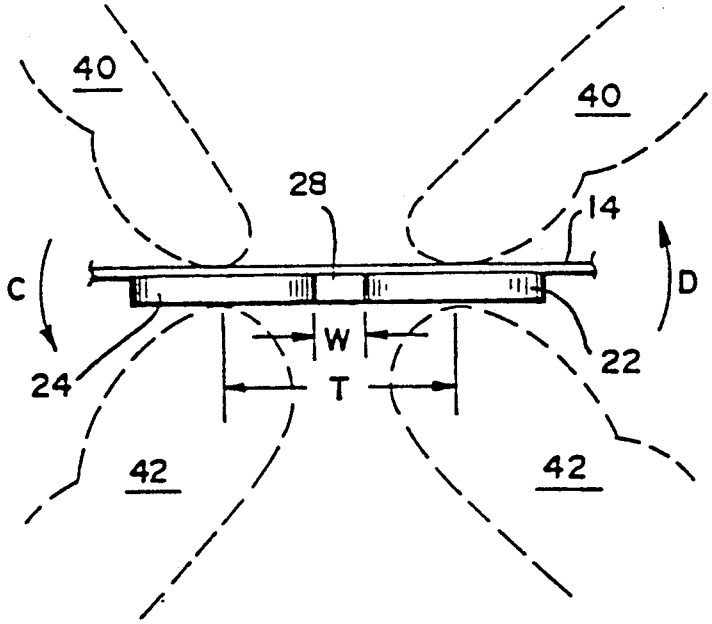
FIG. 4 is a top plan view of the opening device and a portion of the flexible package prior to use.

As can be seen in FIGS. 3 and 4, the first and second wings 22, 24 of the device are preferably sized to provide a gripping surface for a person's fingers 40 and thumbs 42 (broken lines). The wings 22, 24 are gripped between a finger, preferably the index finger, and thumb of each hand. The first and second wings 22, 24 preferably are initially disposed in a flat planar arrangement, as shown in FIG. 4.

Figure 5A:
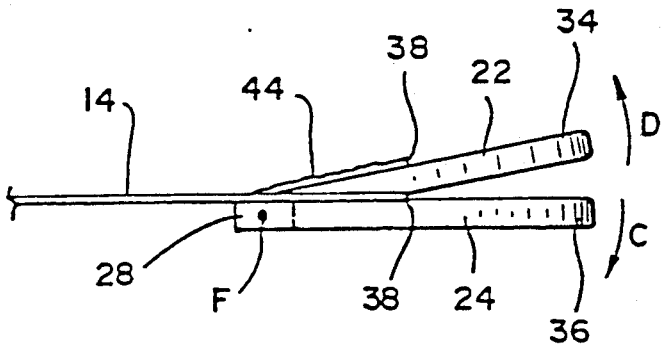
FIGS. 5*a, b* are side views of the opening device and a portion of the flexible package at an earlier and a later stage, respectively, of using the opening device to initiate the opening of the package.
Figure 5B:
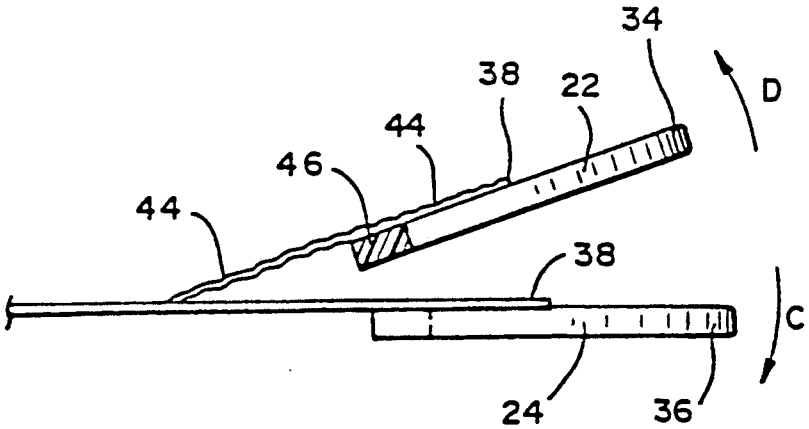

In initiating a tear in the package, the first and second wings 22, 24 are moved relative to one another out of the planar configuration in which they are initially disposed, as indicated by directional arrows C, D (FIGS. 4, 5). Because the wings 22, 24 are initially joined at their proximal end by web 28, the wings each act as levers which are rotated about the web 28, which itself serves as the fulcrum point F (FIG. 5*a*) for each of first and second wings 22, 24.

As can be seen in FIG. 5*a*, first wing 22 and second wing 24 are rotated relative to one another about fulcrum point F, and the portion of the package or bag 14 disposed in the region of slit 30 is sheared to initiate a tear 44 at a peripheral edge 38 of the bag. As the first wing 22 and second wing 24 are rotated further about fulcrum point F, the tear 44 propagates inwardly from peripheral edge 38 toward web 28. The opening device 10 is preferably made of a substantially rigid material, so that wings 22, 24 will properly act as levers in assisting the opening of the bag 14.

In addition to being made of a substantially rigid material, the opening device 10 is also preferably constructed such that the web 28 will break apart at fracture area 46 (FIG. 5*b*) as the distal ends 34, 36 of wings 22, 24 are rotated farther apart from one another. The fracture 46, which separates first wing 22 from second wing 24, will preferably occur in the web just prior to or at the same time as the tear 44 in the bag 14 has propagated to the region of the bag to which web 28 is secured. An opening device designed in this manner allows the wings 22, 24 to provide the increased leverage desired to initiate the tear 44 and to promote the initial propagation of the tear, while at the same time allowing the unobstructed continuation of the tear 46 (FIG. 5*b*), to complete the opening of the package. Once the fracture 46 has occurred, the first wing 22 and second wing 24 may be moved independently of one another, allowing a larger tear to be made.

The desired fracture characteristics of web 28 in opening device 10, are affected by several factors related to the configuration and the material properties of the device. The shape, size, and thickness of the device, including the slit and web configurations, will preferably be closely matched with the strength, rigidity and brittleness of the material from which the device is made such that the fracture will be accomplished at the desired point under average effort or exertion by the person opening the package.

The action of first and second wings 22, 24 as levers increases the shearing force on the package material over that produced by gripping the peripheral edge 38 of the bag with one's thumbs and forefingers alone and applying a tearing or shearing force to the bag. By positioning the opening device 10 such that the distal ends 34, 36 of first and second wings 22, 24 extend outwardly away from the peripheral edge 38 of the bag, while the web 28 comprising the fulcrum is located on the opposite (inner) side of peripheral edge 38, a second-class lever is created. Thus, the mechanical advantage provided by first and second wings 22, 24 in tearing the peripheral edge 38 of the bag increases as the length of the distal ends 34, 36 extending from the peripheral edge 38 is increased. As depicted in FIG. 3, a preferred positioning of the device 10 relative to the peripheral edge 38 of the package 14 leaves approximately two-thirds of the overall length of opening device 10 extending outwardly from the peripheral edge, leaving approximately one-third of the length secured to the package. Such a positioning approximately triples the amount of shear experienced at the peripheral edge of the package, as compared with gripping the package directly, for the same amount of effort employed by the person attempting to open the package.

The ability to initiate and propagate a tear in the package are further improved by concentrating or confining the shearing forces at the portion 50 (FIG. 3) of the peripheral edge of the package between the first wing 22 and second wing 24, i.e. the area defined by slit 30. As depicted in FIG. 4, the width dimension W of the slit 30 is substantially smaller than the width dimension T that is achievable between the thumbs 42 in a comfortable gripping position directly on the package itself. The slit, which may preferably be of a width on the order of 1–2 mm, or possibly even narrower, may be as much as four times narrower than the distance between the thumbs in a comfortable gripping position. The resulting concentration of forces thus substantially reduces the effort required to initiate a tear at the peripheral edge of the package.

The opening device 10 as depicted in FIGS. 1–5 is preferably joined to the bag 14 or other type of package made of flexible packaging material, and particularly polymeric packaging materials, by heat sealing the proximal end 26 of the opening device 10 to the surface of the bag 14 at the desired peripheral surface thereof. The application of a sufficient amount of heat and pressure to the device 10 and the peripheral edge of the bag 14 will substantially irreversibly bond the device 10 to the bag 14, and is believed to be a suitable process for achieving the necessary irreversible bond for many of the packaging materials and opening device materials anticipated for use in connection with the present invention.

Other methods for obtaining the necessary bond between the device and the package may be employed should heat sealing provide impracticable or uneconomical for certain package materials or opening device materials. An adhesive, such as a urethane or an epoxy adhesive may be employed, for example, in securing or bonding an opening device 10 to a polyethylene packaging materials. The surface of the polyurethane may optionally be treated in order to further improve the adhesion of the device to the packaging material, a proposed surface treatment comprising cleaning the surface with isopropyl alcohol or acetone, lightly abrading the surface with sandpaper or wire brush, and dipping the area into a heated solution of sulfuric acid/-potassium dechiromate/water for a short period of time, such as 30 seconds. Other candidate adhesives, depending on the type of packaging material and opening device material employed, include hot melt glues of an ethylene-vinyl acetate or ethylene-ethyl acetate copolymer compositions.

The material from which the opening device 10 is made is preferably selected for both its mechanical properties and its adhesive qualities, including its compatibility with the type of packaging material being employed. A preferred candidate material is crystal styrene, which possesses good strength and rigidity, good brittle fracture characteristics, good adhesive qualities, and low material cost. Other materials which may be suitable for use as the opening device include ABS (acrylonitrile butadiene styrene) plastics, PBT (Polybutylene Terephthalate) plastics, polyacrylate and polycarbonate.

Figure 6:
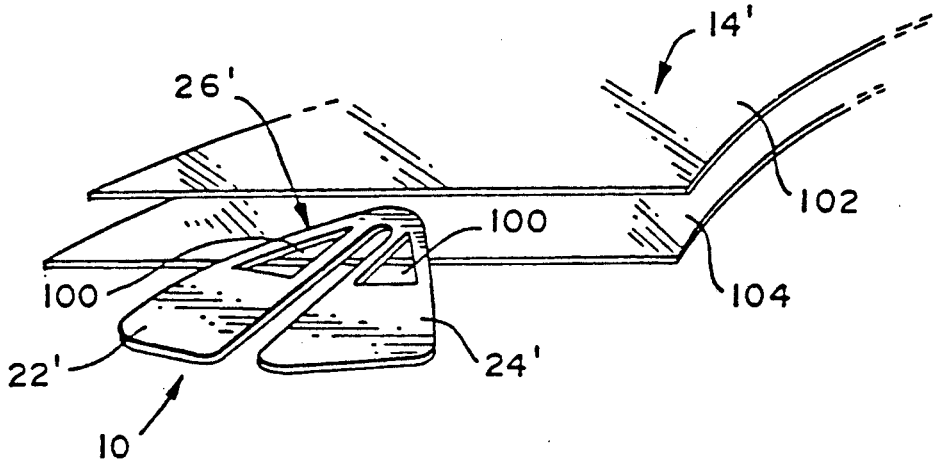
FIG. 6 is a perspective view of an alternative preferred embodiment of the opening device of the present invention and two portions of the flexible packaging to which the device is to be secured.

In some instances, it may be desired to employ a type of flexible packaging material and a opening device material which are incompatible from the standpoint of obtaining a high-quality reliable bond between the materials. In such instances, an alternative embodiment of the opening device of the present invention may be secured to the flexible packaging material using alternative means for holding the device in place. FIG. 6 depicts such an alternative embodiment of the opening device 10', wherein each of a first and second wings 22', 24', have a cutout section 100 disposed at the proximal end 26' of the device. When configured in this manner, the device 10' may be inserted between two edges 102, 104 of the bag 14' prior to the sealing of the bag, and when the bag edges 102, 104 are heat-sealed or otherwise-sealed together, the bag edges will also seal in the areas left open by cutout sections 100. The proximal end 26' of opening device 10' will thus be encased by and captively retained between the sealed edges 102, 104 of the bag 14. The opening device 10' is used to initiate a tear in the bag in the same manner as described with respect to the FIG. 1-5 embodiment of the opening device.

Figure 7:
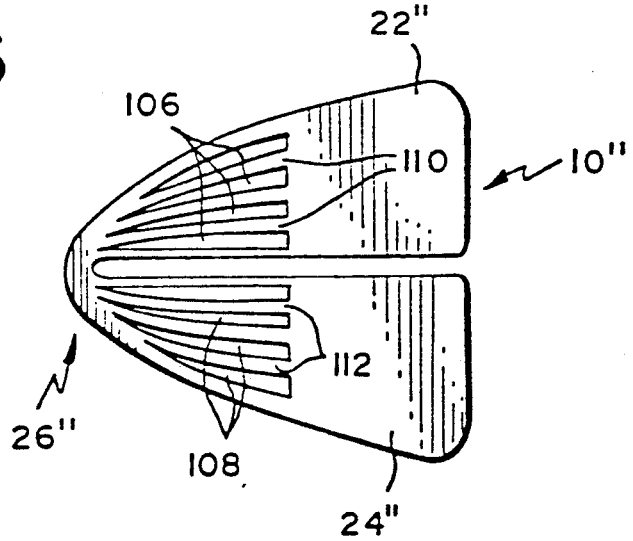
FIG. 7 is an elevation view of an alternative preferred embodiment of the opening device of the present invention.

FIG. 7 depicts a further alternative preferred embodiment of an opening device 10'' in accordance with the present invention. Each of first and second wings 22'', 24'' is provided with a plurality of cutout sections 106, 108, separated by splines 110, 112, the open areas created by the cutout section serving essentially the same purpose as those in the FIG. 6 embodiment, namely to provide open area in the proximal end 26'' of each wing through which the flexible packaging material is permitted to seal upon itself. The FIG. 7 embodiment is believed to provide increased concentration of tearing forces on the peripheral edge of the bag as compared with the FIG. 6 embodiment, and would thus be preferred if the additional concentration of forces is believed to be necessary or desirable in a particular application.

Figure 8:
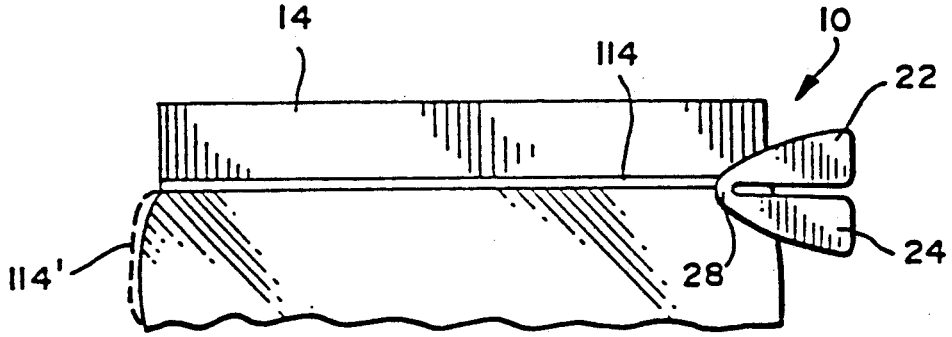
FIG. 8 is an elevation view of an alternative preferred embodiment of the opening device and package of the present invention.

FIG. 8 depicts an alternative preferred embodiment of the opening device 10 of the present invention which is especially well suited for use with more durable flexible packaging materials such as freeze-dried coffee packs or dog food bags currently found in the marketplace. In this embodiment, first wing 22 has a tear string 114 attached at its proximal end. The tear string 114 may preferably be embedded in the packaging material or otherwise attached to the packaging material in a manner known in the art, and will extend across a predetermined portion of the packaging material where it is desired to effect a tear.

In this embodiment, the opening device 10 is operated in the same manner as with the previously described embodiments, and upon achieving fracture at web 28, first wing 22 may be further pulled to initiate the operation of the tear string 114 in propagating a tear across bag 14. The tear string 114 operates in a manner known in the art to concentrate shearing or tearing forces along the string in facilitating the opening of bag 14. The use of the tear string in combination with the opening device provides the ability to initiate a tear and to propagate a tear through tougher and more durable packaging materials using normal human effort without requiring resort to separate cutting or opening tools. The tear string 114 may preferably be made of a fishing line material such as nylon, or other suitable polymeric line materials. The tear string 114 could also have an additional portion, 114', firmly attached to the bag beyond the area of expected tearing, the object being to reduce consumers' inadvertent littering by designing the bag to not separate into two sections after a tear is effected to gain access to the bag's contents (FIG. 8).

The foregoing description includes various details and particular features according to preferred embodiments of the present invention, however, it is to be understood that this is for illustrative purposes only. Various modifications and adaptations may become apparent to those or ordinary skill in the art without departing from the spirit and scope of the present invention. For example, although the wing-like members of the device are depicted as forming an approximately "heart shaped" device, the shape of the wing-like members may take on numerous other forms, provided sufficient area exists for the placement of the fingers and thumbs for gripping the device. Accordingly, the scope of the present invention is to be determined by reference to the appended claims.

I claim

1. An opening device for initiating a tear in a package made of a flexible packaging material comprising:

a substantially rigid first wing and a substantially rigid second wing joined at a proximal end section of said opening device by a web, said first and second wings being retained in a spaced apart manner by said web and extending from said web to define a narrow slit in said space between said first and said second wings, a distal end section of each of said first and said second wings providing a surface of sufficient size to be gripped between a human finger and thumb;

said device being made of a material having greater rigidity than a material of said package;

wherein said package is bounded by at least one peripheral edge and wherein only a predetermined portion of said proximal end section of said opening device is securely bonded to said package at a predetermined portion of said package adjacent said at least one peripheral edge, wherein said distal end sections of said first and second wings of said opening device are not bonded to said package and extend outwardly away from said peripheral edge and wherein a portion of said at least one peripheral edge of said package extends between said first and second wings across said narrow slit.

2. An opening device as defined in claim 1, wherein said first and second wings and said web are integrally formed from a single piece of material.

3. An opening device as defined in claim 2 wherein said first and second wings are initially disposed in a substantially flat planar configuration.

4. An opening device as defined in claim 3 wherein said web is so constructed and arranged to fracture when said first wing and said second wing are rotated a predetermined amount relative to one another out of said substantially planar configuration.

5. An opening device as defined in claim 1 wherein said predetermined portion of said proximal end section of said opening device is heat sealed to an external surface of said package to securely bond said opening device to said package.

6. An opening device as defined in claim 1 further comprising an adhesive disposed between said predetermined portion of said proximal end section of said opening device and said package to securely bond said proximal end section to said package.

7. An opening device as defined in claim 1 wherein said first and second wings are spaced apart at a distance on the order of 1 to 2 millimeters.

8. An opening device as defined in claim 2 wherein said first and second wings and said web are made of a crystal styrene material.

9. An opening device as defined in claim 2 wherein said first and second wings and said web are made of an acrylonitrile butadiene styrene material.

10. An opening device as defined in claim 2 wherein said first and second wings and said web are made of a polycarbonate material.

11. An opening device as defined in claim 2 wherein said first and second wings and said web are made of a polyacrylate material.

12. An opening device as defined in claim 2 wherein said first and second wings and said web are made of a PBT material.

13. A package made of a flexible packaging material having means for initiating a tear in said package, said package being bounded by at least one peripheral edge, said tear initiating means comprising:

a substantially rigid first wing and a substantially rigid second wing joined at a proximal end section of said tear initiating means by a web, said tear initiating means being made of a material having greater rigidity than a material of said package, and wherein only said proximal end section of said tear initiating means is securely bonded to said package along a predetermined portion of said package immediately adjacent to said peripheral edge; said tear initiating means further comprising gripping surface means for gripping said first and second wings disposed at a distal end section of said first and second wings, wherein said gripping surface means at said distal end section are not bonded to said package and said gripping surface means extend outwardly away from said peripheral edge of said package;

wherein said web maintains a predetermined spacing between said first and second wings, said first and second wings defining a narrow slit therebetween extending from said web at said proximal end section to said distal end section of said tear initiating means; and wherein a portion of said peripheral edge of said package is disposed in said narrow slit between said first and second wings.

14. A package as defined in claim 13 wherein each of said first and second wings of said tear initiating means has a cutout section disposed at said proximal end section, said cutout sections leaving open areas in said proximal end sections, and wherein said tear initiating means is securely bonded to said package by inserting said proximal end section between a first and second inner surface of said package to be sealed together, and by sealing said first and second inner surfaces in said open areas of said tear initiating means in an area surrounding said proximal end section.

15. A package made of a flexible packaging material having means for initiating a tear in said package, said tear initiating means comprising:

a substantially rigid first wing and a substantially rigid second wing joined at a proximal end section of said tear initiating means by a web, said proximal end section being securely bonded to said package at a predetermined peripheral extent of said package, and along a predetermined portion of said package immediately adjacent to said peripheral extent; said tear initiating means further comprising gripping surface means for gripping said first and second wings disposed at a distal end section of said first and second wings, said distal end section extending away from said peripheral extent of said package;

wherein said web maintains a predetermined spacing between said first and second wings, said first and second wings defining a narrow slit therebetween extending from said web at said proximal end section to said distal end section of said tear initiating means;

wherein a portion of said peripheral extent of said package is disposed in said narrow slit between said first and second wings; and wherein said tear initiating means further comprises a tear string secured to a proximal end of said first or said second wing and extending across a predetermined portion of said package, said tear string being attached to said package and being adapted to concentrate a tearing force at a region of said package along said tear string.

16. A package as defined in claim 13 wherein said first and second wings and said web are integrally formed from a single piece of material.

17. A package as defined in claim 16 wherein said first and second wings and said web are made of crystal styrene.

18. A package as defined in claim 13 wherein said flexible packaging material comprises a polymeric material.

19. A package as defined in claim 13 wherein said web of said tear initiating means is so constructed and arranged to fracture when said first wing and said second wing are rotated a predetermined amount relative to one another out of an initial substantially flat planar configuration.

20. A package as defined in claim 13 wherein said peripheral extent of said package comprises a substantially planar sealed peripheral edge of said package, and said first wing and said second wing of said tear initiating means are initially disposed in a plane parallel to said sealed peripheral edge.

21. A flexible package opening device for magnifying and concentrating shear force in opening a package, comprising:

a pair of levers comprising a first lever and a second lever;

a fulcrum common to both said first and said second levers, said common fulcrum located at a proximal end section of said device, said first and second levers being joined together at said common fulcrum, said first and second levers having a narrow slit therebetween;

means for separating said first lever and said second lever from each other at said common fulcrum after a tear is propagated in said package;

means for gripping said first lever and said second lever, said gripping means disposed at a distal end of each of said first and second levers;

wherein only a predetermined portion of said proximal end of said device containing said common fulcrum is securely bonded to said package, the gripping means at said distal end of the first and second levers extending free of said package, and wherein said device is operable to tear a portion of said package disposed at said narrow slit between said first and second levers when said first and second levers are rotated in opposite directions about said fulcrum.

22. A flexible package opening device as recited in claim 21, wherein said lever separating means comprises said common fulcrum wherein said fulcrum is constructed of a brittle material adapted to fracture when said first and second levers are rotated by a predetermined amount in opposite directions about said fulcrum.

23. A flexible package opening device as recited in claim 21, wherein said first lever, said second lever and said common fulcrum are integrally formed from a single piece of material.

* * * * *